US005421270A

United States Patent [19]

Kelly

[11] Patent Number: 5,421,270

[45] Date of Patent: Jun. 6, 1995

[54] BASE PANEL FOR BUILDING BLOCKS

[75] Inventor: Ray G. Kelly, St. Louis County, Mo.

[73] Assignee: Angeles Group, Inc., Pacific, Mo.

[21] Appl. No.: 200,578

[22] Filed: Feb. 22, 1994

Related U.S. Application Data

[63] Continuation of Ser. No. 901,957, Jun. 22, 1992, abandoned, which is a continuation-in-part of Ser. No. 780,624, Oct. 23, 1991, Pat. No. 5,263,424, and a continuation-in-part of Ser. No. 651,508, Feb. 6, 1991.

[51] Int. Cl.[6] ..... A47B 85/00

[52] U.S. Cl. ..... 108/25; 108/159; 273/309

[58] Field of Search ..... 108/25, 156, 159, 26; 446/112, 115, 118, 75; 273/309

[56] References Cited

U.S. PATENT DOCUMENTS

| | | | |
|---|---|---|---|
| 1,549,149 | 8/1925 | Miner | 108/159 |
| 3,838,535 | 10/1974 | Larws . | |
| 4,084,816 | 4/1978 | Shafer | 273/309 |
| 4,813,904 | 3/1989 | Larws . | |
| 4,972,781 | 11/1990 | Montgomery et al. | 108/25 |
| 5,055,081 | 10/1991 | Nayak | 108/26 |
| 5,263,424 | 11/1993 | Kelly et al. | 108/91 |

FOREIGN PATENT DOCUMENTS

| | | | |
|---|---|---|---|
| 2659247 | 9/1991 | France | 273/309 |

*Primary Examiner*—Kenneth J. Dorner
*Assistant Examiner*—Gerold A. Anderson
*Attorney, Agent, or Firm*—Paul M. Denk

[57] ABSTRACT

A base panel for use with building blocks has a top surface, edges defining the perimeter of said surface, a circumferential wall extending downwardly from the edges, and a plurality of bores defining a grid in said surface. The bores are square, each side of the bore having a dimension X. The distance between each bore is no greater than ½X. However, the distance between an outer edge of the bores and the edges of the panel is at least X so that a block which fits in the bores and spans the space between the bores, can not be positioned so that a portion of the block overhangs the panel. The panel removably rests on a support.

1 Claim, 3 Drawing Sheets

BASE PANEL FOR BUILDING BLOCKS

CROSS-REFERENCE TO RELATED APPLICATION

This application is designated as a continuation of the application of the same inventor, having Ser. No. 07/901,957, filed on Jun. 22, 1992, now abandoned, being a continuation-in-part application of application having Ser. No. 07/780,624, filed on Oct. 23, 1991, now U.S. Pat. No. 5,263,424; and a continuation-in-part application of application having Ser. No. 07/651,508, filed on Feb. 6, 1991, still pending, said applications being owned by a common assignee.

The subject matter of this patent application is related to an comprises a continuation-in-part of the Letters Patent application upon the invention of Ray G. Kelly and Sharon A. Turnbough pertaining to Utility/Activity Table and Activity Board Therefor, Ser. No. 07/780,624, filed on Oct. 23, 1991, and also includes a continuation-in-part of the design patent application filed upon the invention of Ray G. Kelly pertaining to Utility And/Or Activity Table, Ser. No 07/651,508, filed on Feb. 6, 1991; both of said applications being assigned to a common assignee.

BACKGROUND OF THE INVENTION

This invention relates to base panels for use with building blocks.

Nurseries, kindergarten classrooms, and the like often have building blocks for the, children to play with. Generally H-shaped blocks such as are shown and described in U.S. Pat. No. 3,838,535 to Larws are often used in these classrooms. The H-shaped building blocks of the '535 patent work well with the panel shown and described in U.S. Pat. No. 4,813,904, also to Larws. The Larws panel is a generally square panel with a plurality of square openings forming a grid pattern. The H-shaped blocks are received in the panel openings to be supported by the panel. However, when the blocks of the '535 patent are used with the panel of the '904 patent, the geometry of the Larws panel allows the blocks may extend over the panel's edge. This exposes sharp corners and edges on which children may be scratched or otherwise injured.

Other patented structures, of the prior art, showing related devices are disclosed in the patent to Zander, U.S. Pat. No. 3,274,727, in addition to the patent to Lin, U.S. Pat. No. 4,164,091. Other types of building block structures are shown in the patent to Larws, U.S. Pat. No. 4,519,786, while the German patent No. 1,140,500, shows related building block structures. These are examples of known prior art.

SUMMARY OF THE INVENTION

One object of this invention is to provide a panel which limits the sharp corners and edges that are exposed.

Yet another object of this invention is to provide a table top surface, that may also be used as a cover for stacked items, and which includes a plurality of spaced openings into building block structures may be inserted and developed.

Other objects will become apparent to those skilled in the art in light of the following disclosure and accompanying drawings.

In accordance with the invention, generally stated, a base panel for blocks is provided. The base panel has a top surface, edges defining the perimeter of said surface, a circumferential wall extending downwardly from the edges, and a plurality of bores defining a grid in said surface. The bores are square, each side of having a dimension X. The distance between each bore is no greater than ½X, and the distance between an outer edge of the bores and the edges of the panel is at least X. The panel also includes a well formed in the surface for storing blocks. An upwardly extending rim surrounds the well.

The base panel rests on a support. The support includes a frame of the same shape of the top surface and legs depending from the frame. The frame is sized so that the frame is adjacent on inner side of the panel wall when the panel is placed on the support means.

DESCRIPTION OF THE PREFERRED EMBODIMENT

Figure 1:
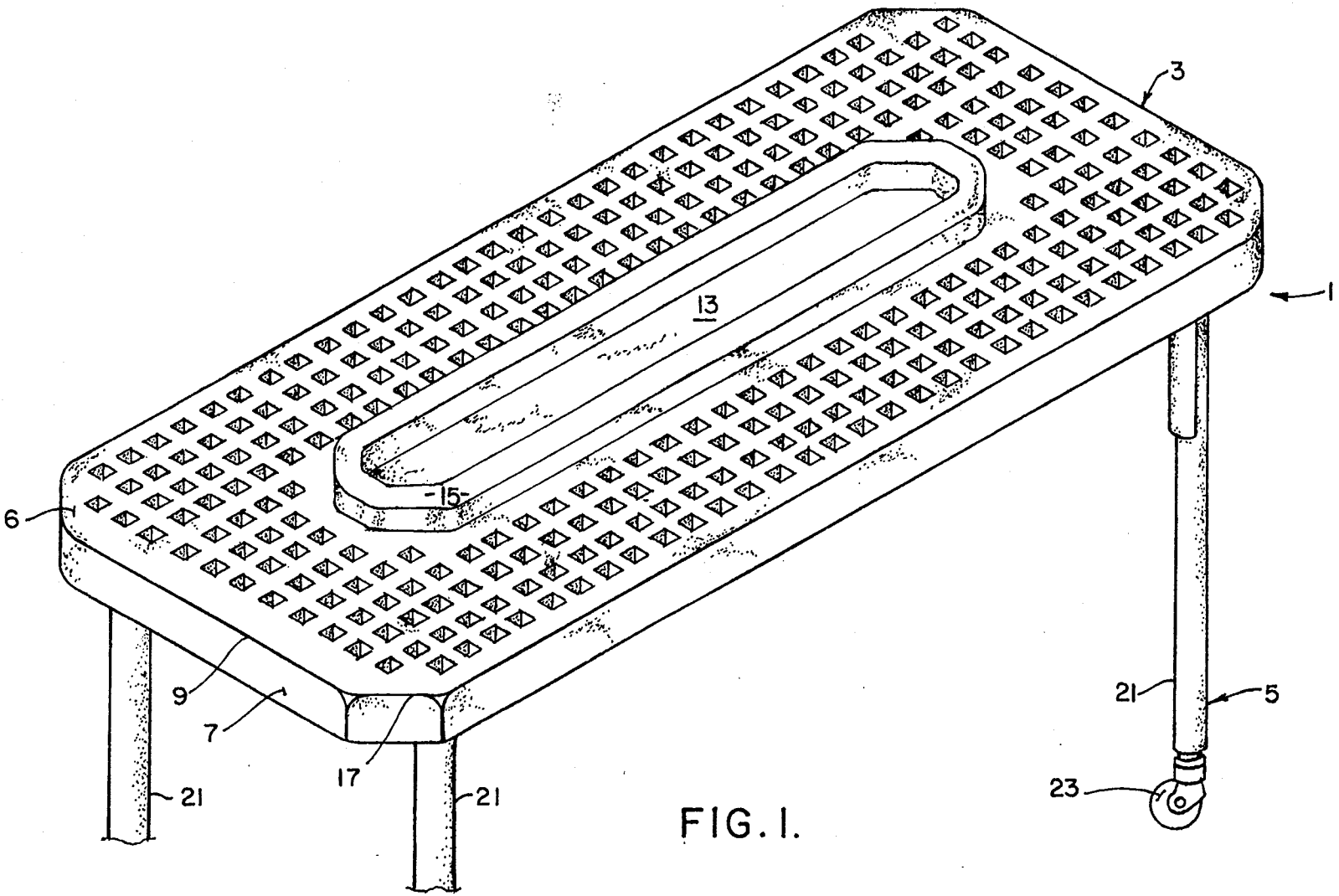
FIG. 1 is a perspective view of a panel assembly of the present invention.
Figure 2:
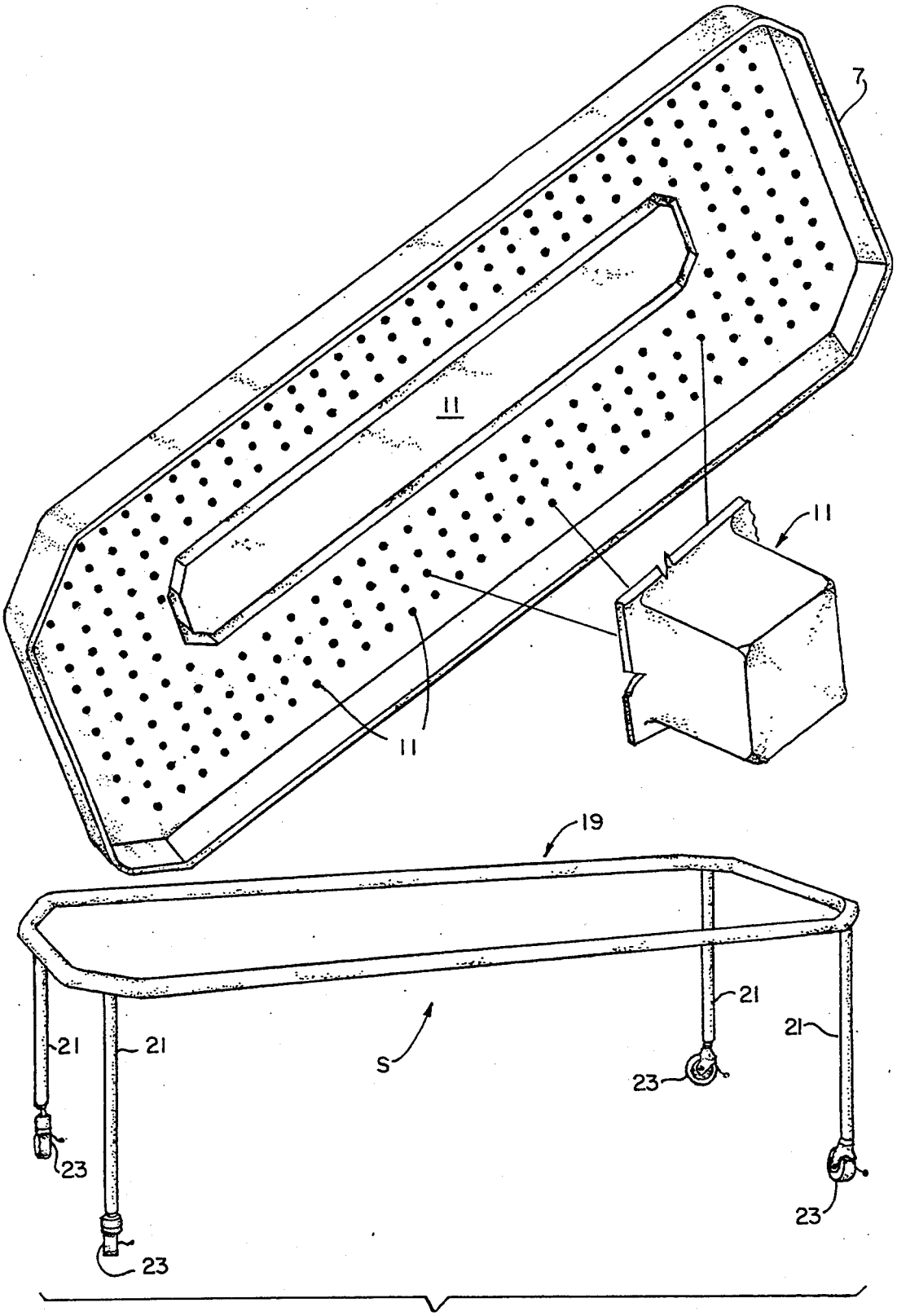
FIG. 2 is an exploded view of the panel assembly.
Figure 3:
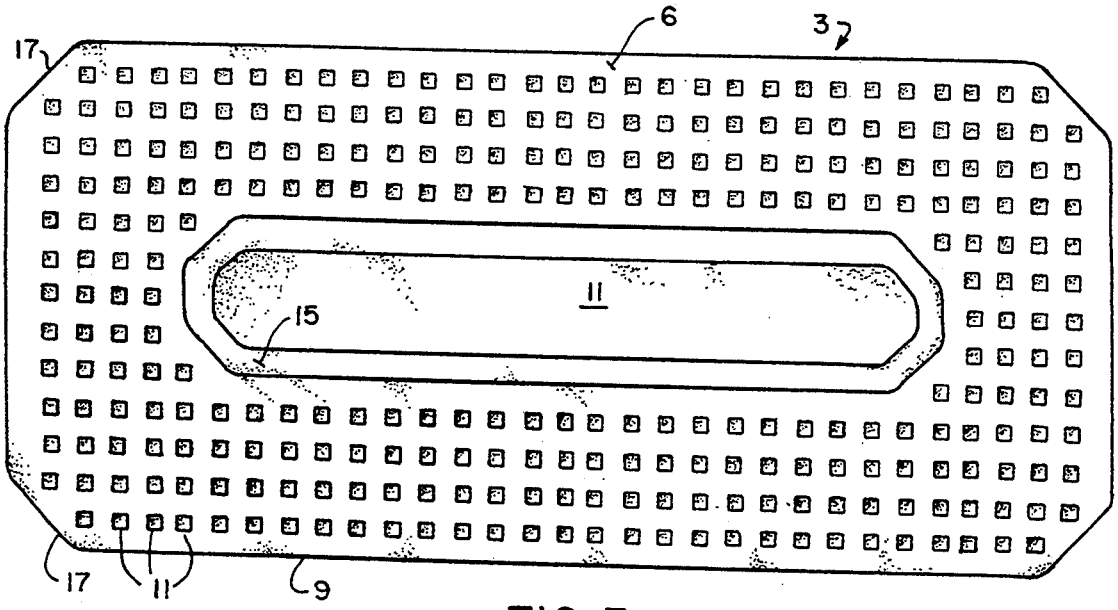
FIG. 3 is a top plan view of a panel of the assembly.
Figure 4:
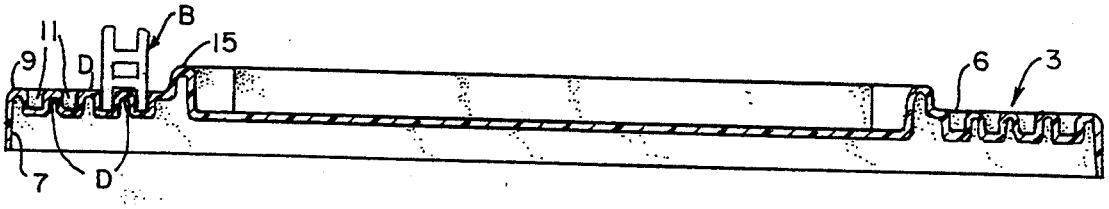
FIG. 4 is a side elevational view of the panel.
Figure 5:
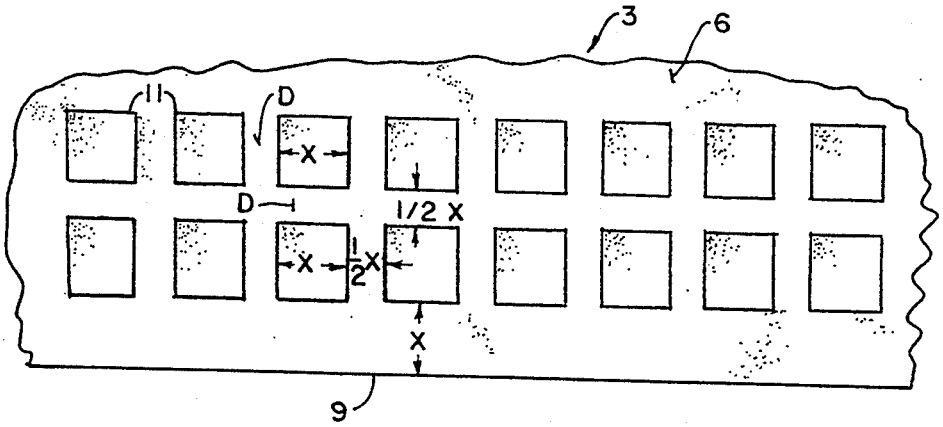
FIG. 5 is a fragmentary plan view of the panel.

Referring to the Figures, a panel assembly 1 includes a panel 3 and a support 5. The panel 3 includes a top surface 6 having a circumferential wall 7 which depends downwardly from the edge 9 of the surface. A plurality of bores 11 are formed in parallel rows and columns to form a grid in surface 6 defined by dividers D. Bores 11 are preferably blind bores, but may be through bores or configured aperatures. Bores 11 are square in shape, each side of the bore having a dimension X which is preferably about 0.75 inch. The distance between neighboring rows and columns is preferably about ½X or 0.375 inch, to allow a block B to straddle the divider D between bores 11. The distance between the edges of bore 11 and the edge 9 of surface 3 is at least X, i.e., the same size as bore 11. Thus, a block cannot straddle the space between the bore and the edge and no sharp edges are presented around the wall 7 which may scratch or otherwise injure a child.

A well 13 is formed in the center of surface 6 and can be used to store blocks. Well 13 is surrounded by an upwardly extending wall 15, which effectively deepens well 13.

All edges of surface 3 are rounded so that no sharp edges or corners exist on which children can injure themselves. The edges 9 are beveled as at 17 to further decrease the sharpness of the corner of surface 3.

Surface 3 rests on support 5 and may be removed therefrom for cleaning, storage, etc. Support 5 has a frame 19 which is shaped complimentary to the inside of surface wall 7. Frame 5 is sized so that surface 3 may easily be placed over frame 19, but so that surface 3 will not move when on frame 19. A plurality of legs 21 depend from frame 19. Legs 21 may have wheels or rollers 23, as are shown.

It is just as likely that the base panel of this invention, for use in combination with building blocks, can likewise be applied to a series of stacked items, such as the plurality of cots as shown in FIG. 1 of the co-pending application having Ser. No. 07/780,624, and which contents of said co-pending application are incorporated herein by reference.

Numerous variations, within the scope of the appended claims, will be apparent to those skilled in the art in light of the foregoing description and accompanying drawings.

Having thus described the invention, what is claimed and desired to be secured by Letters Patent is:

1. A base panel for use with building blocks, said base panel having a top surface supported in a horizontal plane having edges defining a perimeter of said top surface, said edges extending downwardly to form a panel wall around the perimeter of the base panel, and said base panel having a plurality of bores defining a grid in said top surface, said bores being square, each side of said bore having a dimension X, the distance between each said bore being no greater than ½X, and the distance between the outer edge of said bores and the peripheral edges of the top surface being at least X, and a support means for supporting said top surface, said support means including a frame of the same shape of said top surface and having legs depending downwardly from said frame, said frame being sized so that said frame is maintained adjacent an interior surface of said panel wall when the panel is placed on said support means, said base panel being removably placed on said support means, said panel further including means for storing building blocks, said storing means includes a well formed in said surface, said well having a well base, said well base being on the same horizontal plane as the top surface, an upwardly extending rim surrounding said well, said rim extending continuously around the well in forming the storing means, and whereby users of the base panel may apply the building blocks to a pair of adjacent bores, but are precluded from applying the building blocks at the perimeter edge of the top surface such that the blocks do not overlap the perimeter edges of said base panel top surface.

* * * * *